US006536182B2

(12) United States Patent
France

(10) Patent No.: US 6,536,182 B2
(45) Date of Patent: Mar. 25, 2003

(54) INTEGRATED MULTIPANE WINDOW UNIT AND SASH ASSEMBLY AND METHOD FOR MANUFACTURING THE SAME

(75) Inventor: John S. France, Cuyahoga Falls, OH (US)

(73) Assignee: Sashlite, LLC., Westport, CT (US)

( * ) Notice: Subject to any disclaimer, the term of this patent is extended or adjusted under 35 U.S.C. 154(b) by 0 days.

(21) Appl. No.: 09/907,528

(22) Filed: Jul. 17, 2001

(65) Prior Publication Data

US 2002/0046545 A1 Apr. 25, 2002

Related U.S. Application Data

(63) Continuation of application No. 09/307,825, filed on May 7, 1999, now Pat. No. 6,286,288, which is a continuation-in-part of application No. 08/935,924, filed on Sep. 23, 1997, now abandoned.

(60) Provisional application No. 60/032,776, filed on Dec. 5, 1996.

(51) Int. Cl.[7] ..... E06B 3/24; E06B 3/64; E06B 3/66; E06B 3/663

(52) U.S. Cl. ..... 52/786.1; 52/786.13; 52/788.1; 52/204.6; 52/204.62; 428/34

(58) Field of Search ..... 52/786.1, 786.13, 52/788.1, 204.6, 204.62, 204.7, 204.53, 204.593, 204.597, 204.69, 204.71, 172, 745.15, 745.16, 745.19; 428/34; 156/109

(56) References Cited

U.S. PATENT DOCUMENTS

| | | | | |
|---|---|---|---|---|
| 309,636 A | | 12/1884 | Mann | |
| 2,563,378 A | * | 8/1951 | Schnee | 52/172 |
| 2,993,242 A | | 7/1961 | Leisibach | |

(List continued on next page.)

FOREIGN PATENT DOCUMENTS

| | | |
|---|---|---|
| CA | 728445 | 2/1966 |
| CH | 209284 | 6/1940 |
| CH | 340607 | 10/1959 |
| CH | 378513 | 7/1964 |
| CH | 433 675 | 9/1967 |
| DE | L 17545 | 12/1956 |
| DE | 1123457 | 2/1962 |
| DE | 1915245 | 10/1970 |
| DE | 2041038 | 2/1971 |
| DE | 25 27 013 | 1/1976 |
| DE | 24 49 726 | 4/1976 |
| DE | 24 57 472 | 6/1976 |
| DE | 26 14 049 | 6/1976 |
| DE | 26 07 287 | 8/1977 |
| DE | 27 23 283 | 4/1979 |
| DE | 89 01 593 | 3/1989 |
| DE | 38 25 580 | 2/1990 |
| EP | 0 065 510 | 11/1982 |
| EP | 0 328 823 | 8/1989 |
| EP | 0 381 646 | 8/1990 |
| FR | 1079389 | 11/1954 |
| FR | 60912 | 2/1955 |
| FR | 1429980 | 1/1966 |
| FR | 1 459 169 | 4/1966 |
| FR | 2420014 | 11/1979 |

(List continued on next page.)

*Primary Examiner*—Carl D. Friedman
*Assistant Examiner*—Brian E. Glessner
(74) *Attorney, Agent, or Firm*—Barry R. Lipsitz

(57) ABSTRACT

A multipane window unit is provided in which a sash frame is formed having an integral spacing structure upon which glazing panes are directly affixed. The spacing structure is formed integrally with the sash frame at internal glazing surfaces. Adhesive can be affixed to the internal glazing surfaces to attach the glazing panes. In this manner, a rigid, structural sash frame can be formed prior to attachment of the glazing panes, thereby eliminating the need for using separately manufactured insulating glass units while obtaining similar and improved benefits.

37 Claims, 6 Drawing Sheets

U.S. PATENT DOCUMENTS

| | | | |
|---|---|---|---|
| 3,008,196 | A | 11/1961 | Springer et al. |
| 3,030,673 | A | 4/1962 | London |
| 3,054,153 | A | 9/1962 | Partsch |
| 3,775,914 | A | 12/1973 | Patil |
| 3,791,910 | A | 2/1974 | Bowser |
| 3,872,198 | A | 3/1975 | Britton |
| 3,919,023 | A | 11/1975 | Bowser et al. |
| 3,990,196 | A | 11/1976 | Eddins |
| 4,015,394 | A | 4/1977 | Kessler |
| 4,055,031 | A | 10/1977 | Okawa et al. |
| 4,109,432 | A | 8/1978 | Pilz |
| 4,149,348 | A | 4/1979 | Pyzewski |
| 4,207,869 | A | 6/1980 | Hart |
| 4,368,226 | A | 1/1983 | Mucaria |
| 4,407,105 | A | 10/1983 | Frank |
| 4,454,703 | A | 6/1984 | Sitzler et al. |
| 4,459,789 | A | 7/1984 | Ford |
| 4,464,874 | A | 8/1984 | Shea, Jr. et al. |
| 4,479,988 | A | 10/1984 | Dawson |
| 4,552,790 | A | 11/1985 | Francis |
| 4,564,540 | A | 1/1986 | Davies et al. |
| 4,608,796 | A | 9/1986 | Shea, Jr. |
| 4,652,472 | A | 3/1987 | Davies |
| 4,753,056 | A | 6/1988 | Pacca |
| 4,791,762 | A | 12/1988 | Hwang |
| 4,831,799 | A | 5/1989 | Glover et al. |
| 4,850,175 | A | 7/1989 | Berdan |
| 4,873,803 | A | 10/1989 | Rundo |
| 4,928,448 | A | 5/1990 | Phillip |
| 4,994,309 | A | 2/1991 | Reichert et al. |
| 5,061,531 | A | 10/1991 | Catalano |
| 5,097,642 | A | 3/1992 | Richardson et al. |
| 5,107,655 | A | 4/1992 | Lindgren |
| 5,177,916 | A | 1/1993 | Misera et al. |
| 5,251,417 | A | 10/1993 | Yates, Jr. |
| 5,295,292 | A | 3/1994 | Leopold |
| 5,313,761 | A | 5/1994 | Leopold |
| 5,364,921 | A | 11/1994 | Gray et al. |
| 5,437,902 | A | 8/1995 | Itoh et al. |
| 5,494,715 | A | 2/1996 | Glover |
| 5,544,454 | A | 8/1996 | Richardson et al. |
| 5,568,714 | A | 10/1996 | Peterson |
| 5,640,828 | A | 6/1997 | Reeves et al. |
| 5,653,073 | A | 8/1997 | Palmer |
| 5,665,823 | A | 9/1997 | Saxena et al. |
| 5,950,398 | A | 9/1999 | Hubbard |
| 6,055,783 | A | 5/2000 | Guhl et al. |
| 6,209,269 | B1 * | 4/2001 | Valderrama ..... 52/786.1 X |
| 6,286,288 | B1 * | 9/2001 | France ..... 52/786.1 |
| 6,401,428 | B1 | 6/2002 | Glover et al. |

FOREIGN PATENT DOCUMENTS

| | | |
|---|---|---|
| FR | 2501773 | 9/1982 |
| FR | 2518158 | 6/1983 |
| FR | 2612244 | 9/1988 |
| FR | 2624545 | 6/1989 |
| FR | 2648178 | 12/1990 |
| FR | 2 653 470 | 4/1991 |
| FR | 2 672 930 | 8/1992 |
| FR | 2708030 | 1/1995 |
| GB | 234987 | 6/1925 |
| GB | 949997 | 2/1964 |
| GB | 1 535 173 | 12/1978 |
| GB | 2 077 834 | 12/1981 |
| GB | 2 254 358 | 10/1992 |
| HU | 185 075 | 10/1983 |
| HU | 219 640 | 3/1996 |
| IT | 628775 | 11/1961 |
| SU | 726293 | 4/1980 |
| WO | 91/08366 | 6/1991 |
| WO | 98/02632 | 1/1998 |
| WO | 98/25001 | 6/1998 |

* cited by examiner

INTEGRATED MULTIPANE WINDOW UNIT AND SASH ASSEMBLY AND METHOD FOR MANUFACTURING THE SAME

This application is a continuation of U.S. patent application Ser. No. 09/307,825 filed on May 7, 1999, now U.S. Pat. No. 6,286,288, which was a continuation-in-part of U.S. patent application Ser. No. 08/935,924 filed on Sep. 23, 1997, now abandoned, which claimed priority from U.S. provisional application 60/032,776 filed on Dec. 5, 1996.

BACKGROUND OF THE INVENTION

1. Field of the Invention

The present invention relates generally to commercial, residential and architectural windows and, more particularly, to an integrated multipane window unit and sash assembly and a method for manufacturing the same.

2. Description of the Related Art

As is currently well-known in the art, insulating glass units, or IG units, are currently widely used as elements of windows and doors. Such units are used in windows and doors to reduce heat loss from building interiors in winter, and reduce heat gain into air-conditioned buildings in summer. The insulating glass units are typically formed separate from the sash, and then in a separate step the insulating glass unit is installed in a sash.

IG units generally consist of two parallel sheets of glass which are spaced apart from each other and which have the space between the panes sealed along the peripheries of the panes to enclose an air space between them. Spacer bars are placed along the periphery of the space between the two panes. The spacers are assembled into generally rectangular shaped frames either by bending or by the use of corner keys.

As has evolved in the present commercially successful technology, insulating glass units form only the internal components of a sash element used in a window unit. A sash element forms the working element of the window, and forms a perimeter called a sash frame that holds necessary working hardware to allow the sash element to slide, locks, crank, et cetera.

Although many materials of construction are conventionally utilized for manufacturing of sash elements, such as wood and aluminum, presently available insulating window units that utilize a sash element formed of extruded polyvinyl chloride polymers are known to provide a superior insulating effect in conventional commercial and residential applications.

In the manufacture of conventional sash, one starts with extrusion called a "profile." These extrusions can be purchased from an extrusion manufacturer designed to make a style having a certain aesthetic. Extrusions can be made generally available to the marketplace; however, a general practice that has developed is to provide a partial exclusivity by region, market, etc. in order to allow a particular window manufacturer to associate a certain aesthetic with that manufacturer's product. Therefore, although many extrusion profiles are of an original design, they are treated in the marketplace as a quasi-commodity.

Another aspect of the extrusion profile is that given that the exterior surface must mate with the main frame, the profile is also functional as well as aesthetic. In order to accomplish this functionality, changes are made in internal grooves, channels, etc.

The next element in the manufacture of a sash is to cut corner miters in the sash element. These cuts are made in an oversized manner, by ¼ to ⅛ inch. This additional material is to allow for a process called vinyl welding, in which both seams are heated to a point wherein the PVC material softens and the joint is pressed together and cooled in place to form a cohesive bond. This process forms a corner joint that is stronger than the original extrusion.

The manufacture of the sash results in a four-sided sash frame. However, a flash buildup or 'swath' is formed by the vinyl welding process, which must be milled, cut, scraped, or otherwise removed. This process is called corner cleaning, and is generally accomplished by a separate piece of manufacturing equipment called a corner cleaner.

At this point the sash frame is now ready for glazing. Glazing is typically accomplished by one of two processes. The first readily used process is when an adhesive strip called a glazing tape is attached to a structure on the profile called the glazing leg. Next, an IG unit is adhered to the other side of the glazing tape, and glazing stops are then placed over the IG unit in order to hold the exterior of the IG unit. This process has advantages, in that the equipment and technology to accomplish this is skewed toward the glazing strip manufacturer, and the window manufacturer can form the window with less equipment and capital outlays. However, the drawbacks to this method lie in the increased cost of and limited materials that can be formed into glazing tapes.

The alternative method of glazing is by a process called back-bedding sealing. In this method, a sash frame is placed horizontally on an X-Y back-bedding machine that will lay down a continuous bead of fluid back bedding sealant along the glazing leg. The IG unit is then adhered to the back bedding, and glazing stops are attached. In this method, the back bedding material creates a seal between IG unit and the sash frame. Although additional equipment is required, this process allows the use of a variety of materials, including silicone adhesives, that have advantageous price and/or performance characteristics.

In all cases, IG units must necessarily be manufactured separately, and many times are made by a separate company. The trend is to move this step inhouse to control costs, size, availability, etc. Also, by controlling more directly the IG unit manufacture, both markets, retrofit (custom) and standard sizes (new installation) can be addressed.

The manufacturing of conventional IG units, as utilized in the manufacture of PVC insulating windows, has been thoroughly addressed within the art, and is meant to be incorporated herein. For purposes of identifying structures and for providing a frame of reference for the present invention, this manufacture shall be briefly discussed. First, a spacer bar is formed, generally of a hollow, roll-formed flat metal, into a hollow channel. Generally, a desiccant material is placed within the hollow channel, and some provisions are made for the desiccant to come into fluid communication with or otherwise affect the interior space of the IG unit. The spacer bar is then notched in order to allow it to be formed into a rectangular frame. Due to the nature and geometry of this frame, the IG unit at this point has very little structural rigidity. At this point a sealant is applied to the outer three sides of the spacer bar in order to bond a pair of glass panes to either opposite side of the spacer bar. There are a variety of sealants well known in the art that can be used for this purpose. After application of the glass panes and curing of the sealant, the IG unit finally has structural integrity. The current state of the art is represented by U.S. Pat. No. 5,313,761, issued in the name of Leopold, in which hot melt butyl is directly applied to a spacer element that incorporates a folding corner key. Such a method is embodied in a very difficult and clumsy manufacturing process that incorporates a number of inherent manufacturing problems.

A number of other problems exist with the current state of the art in IG unit performance. The use of polyurethane or polysulfide sealants, because of their non-pliable nature when cured, can cause stress fractures of the glass after periods of thermal cycling that cause expansion and contraction of the elements. This leads to fog or moisture intrusion into the interior air space. The use of polyisobutelene sealants have been attempted due to their excellent moisture barrier properties. However, poor structural integrity results. And, although silicone is a strong sealant material, it is porous to moisture intrusion and cannot be used by itself, and must be used as part of a double seal unit (dual seal).

Other recent issues have arisen that have yet to be addressed by the art, and can be characterized by a standard called the "warm edge test". The warm edge test is a thermal conductivity test that rates the insulating properties the IG unit, and is a method of quantifying the insulating capacity of an assembled insulating window, and not just of the component parts. The driving force for this characterization is governmental regulations that require structures to have certain outside thermal envelope characteristics. However, because of the metal spacer necessary and the inevitable increase in thermal conductance caused by such a structure, conventional IG units perform poorly in this regard. This is mainly due to the fact that conventional IG units were designed to provide insulating properties along the viewable glass area and not increase insulating properties along the perimeter sash and frame areas.

The current state of the art for this technology is also represented by U.S. Pat. No. 5,313,761, issued in the name of Leopold, in which "U" shaped spacers without corner keys are used such that conduits for conductive heat transfer are reduced. Also, the elimination of corner keys eliminates a natural leak point in the system.

Consequently, a need has therefore been felt for an improved but less complex mechanism that provides a thermally sealed and structurally sealed air pocket bounded on two sides by a glazing pane, for use in otherwise conventional functioning windows.

SUMMARY OF THE INVENTION

It has been found that the qualities of well performing thermal air space allow for glazing materials such as glass or plastic (e.g., Plexiglas, a thermoplastic polymer of methyl methacrylate) to expand and contract without stress on the glazing pane to a point where stress fractures would occur; or, to allow sealant to deform to a point where it fails to maintain structural integrity.

Further, it has been found that stresses between the glazing pane and sealant will inevitably take place, and therefore the design of a window sash must allow such stress and movement to occur in a manner that diminishes the full load of such forces on the glazing pane and sealant.

Further, it has been found that the contact of the IG unit with the sash causes the sash to function as a radiator of heat, and consequently, a transmitter of vibration and sound.

Further still, it has been found that the expansion coefficient of glass is less than that of the sash profile extrusion; therefore, any assembly should preferably keep any glass (or other glazing material with a different coefficient of expansion than the sash profile) from making direct contact with the extrusion material, e.g., vinyl.

It would be advantageous to provide methods for fabricating devices of the type disclosed above, which avoid the disadvantages inherent in the state of the art.

It is therefore an object of the invention to provide an improved integrated multipane window unit and sash assembly.

It is another object of the invention to provide an improved method for manufacturing such a multipane window unit.

It is a feature of the present invention to provide an integrated multipane window unit and sash assembly that forms both a thermally sealed and structurally sealed air pocket bounded on two sides by glazing panes, e.g., of glass or plastic, and around its periphery by an internal glazing leg.

It is another feature of the present invention to provide a method for assembling an integrated multipane window unit and sash that allows for glass to expand and contract without stresses that result in failure on either the glass or the sealant.

It is another feature of the present invention to provide an integrated multipane window unit and sash assembly that allows the glazing pane to rest above any extrusion shelf structure, thereby eliminating any stress against the edge of the glass that could cause cracking and providing for water drainage away from the sealant, thereby lessening the opportunity for the sealant to come into contact with water.

It is another feature of the present invention to provide an integrated multipane window unit and sash assembly that includes an offset section in the sash profile that is downward sloping to assist in evacuation of moisture.

It is another feature of the present invention to provide an integrated multipane window unit and sash assembly that allows for the use of a glazing bead (sometimes referred to herein as a glazing clip) in a manner that holds glass in place temporarily while allowing the sealant to cure during the manufacturing process.

It is another feature of the present invention to provide an integrated multipane window unit and sash assembly that utilizes a sealant for both adhesive purposes as well as to form a vapor barrier.

It is another feature of the present invention to provide an integrated multipane window unit and sash assembly that allows the glazing panes to "float" on sealant, thereby preventing direct contact of glass to the sash profile material.

It is another feature of the present invention to provide an integrated multipane window unit and sash assembly that allows desiccant to be truly isolated from any exterior source, thereby preventing the loading of the desiccant with moisture.

It is another feature of the present invention to provide an integrated multipane window unit and sash assembly that provides added sound deadening characteristics.

It is another feature of the present invention to provide an integrated multipane window unit and sash assembly that allows for the elimination of separately manufactured and installed conventional type IG units.

It is another feature of the present invention to provide a process for manufacturing such an integrated multipane window unit and sash assembly.

Briefly described according to one embodiment of the present invention, an integrated multipane window unit and sash combination is disclosed having a sash frame that incorporates an integral spacing structure formed integrally with the sash frame and protruding toward the viewing opening. The integral spacing structure incorporates internal glazing surfaces upon which adhesive is affixed. In this configuration, the portions of sealant connecting each pane to the sash element are isolated from each other, thereby allowing each piece of glass to function separately.

An advantage of the present apparatus can be readily seen from the present disclosure; however, they can be summarized in the providing of both a superior performing multipane window unit, and an improved method of manufacturing the same.

Briefly described according to one method of manufacturing such an embodiment of the present invention, the use of an integrated multipane window unit and sash combination having integral spacing structure formed integrally with the sash frame and protruding toward the viewing opening allows for an efficient manufacturing process in which the sash can be formed initially in an otherwise conventional manner. Subsequent to the initial forming of a structurally rigid sash member, sealant, either of a structural type, vapor barrier type, a combined type, or both types, can be applied directly to the vertical internal glazing surfaces of the finished sash frame. Next, because the internal glazing surfaces and spacing structure protrude toward the viewing opening, the glass panes can then be affixed to the sealant. At this point, a glazing clip can optionally be affixed in a manner that holds the glass in place temporarily while allowing the sealant to cure during the manufacturing process.

Advantages of the present method can be readily seen from the present disclosure; however, they can be summarized in the providing of such a window unit in a manner that is less capital intensive and requires fewer manufacturing steps, equipment and personnel than what is required to manufacture windows using exiting IG units.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Apparatus

Figure 1:
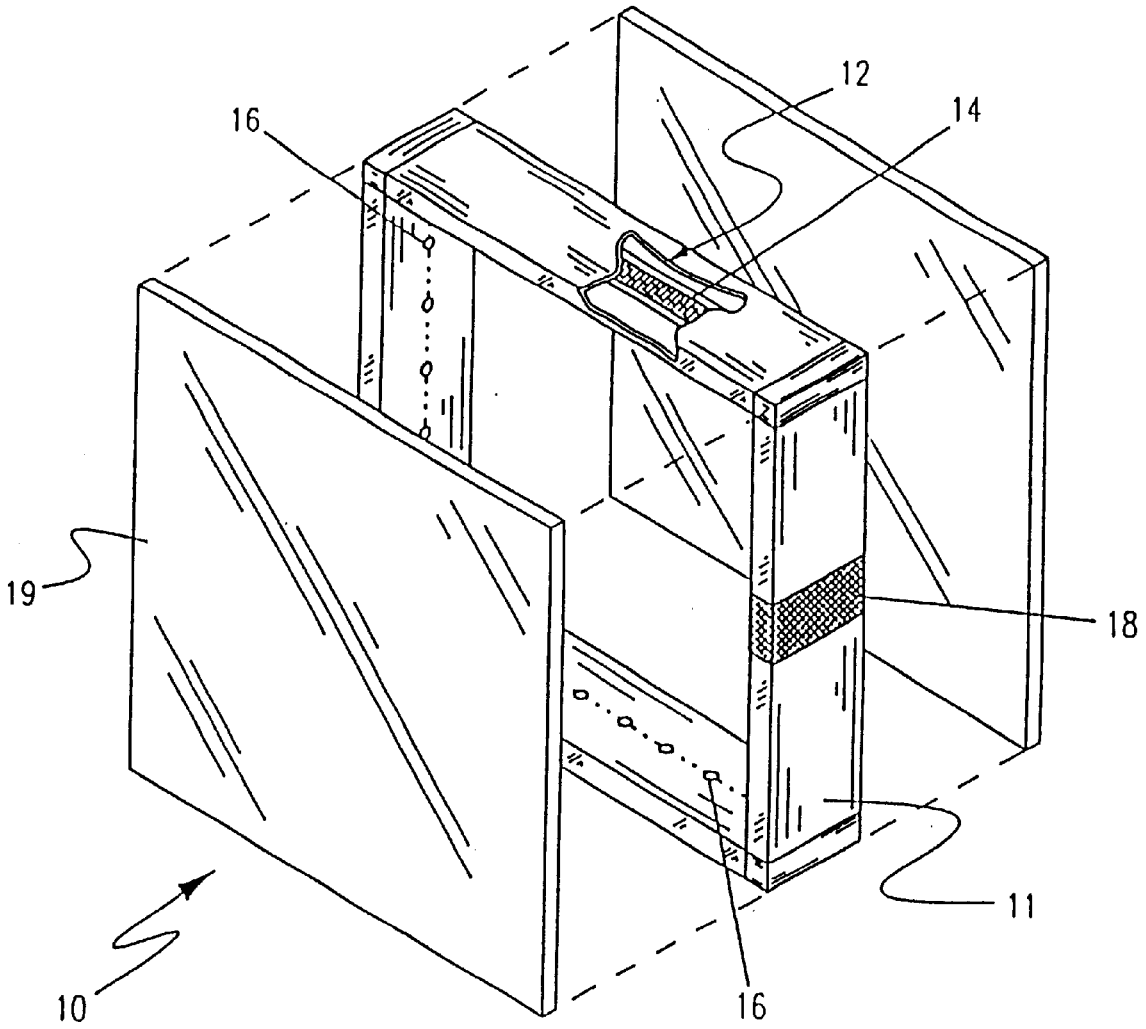
FIG. 1 PRIOR ART
FIG. 1 is an exploded perspective view of a window sash frame according to the prior art.

Referring now to FIG. 1, a conventional IG unit 10, as utilized in the manufacture of PVC insulating windows, is shown. A spacer bar 11, formed generally of a hollow, roll-formed flat metal, forms a hollow channel 12. A desiccant material 14 is placed within the hollow channel 12, and fluid conduits 16 are provided for the desiccant to come into fluid communication with or otherwise affect the interior space of the IG unit 10. Sealant 18 is applied to the outer three sides of the spacer bar 11 in order to bond a pair of glass panes 19 to opposite sides of the spacer bar 11.

Figure 2:
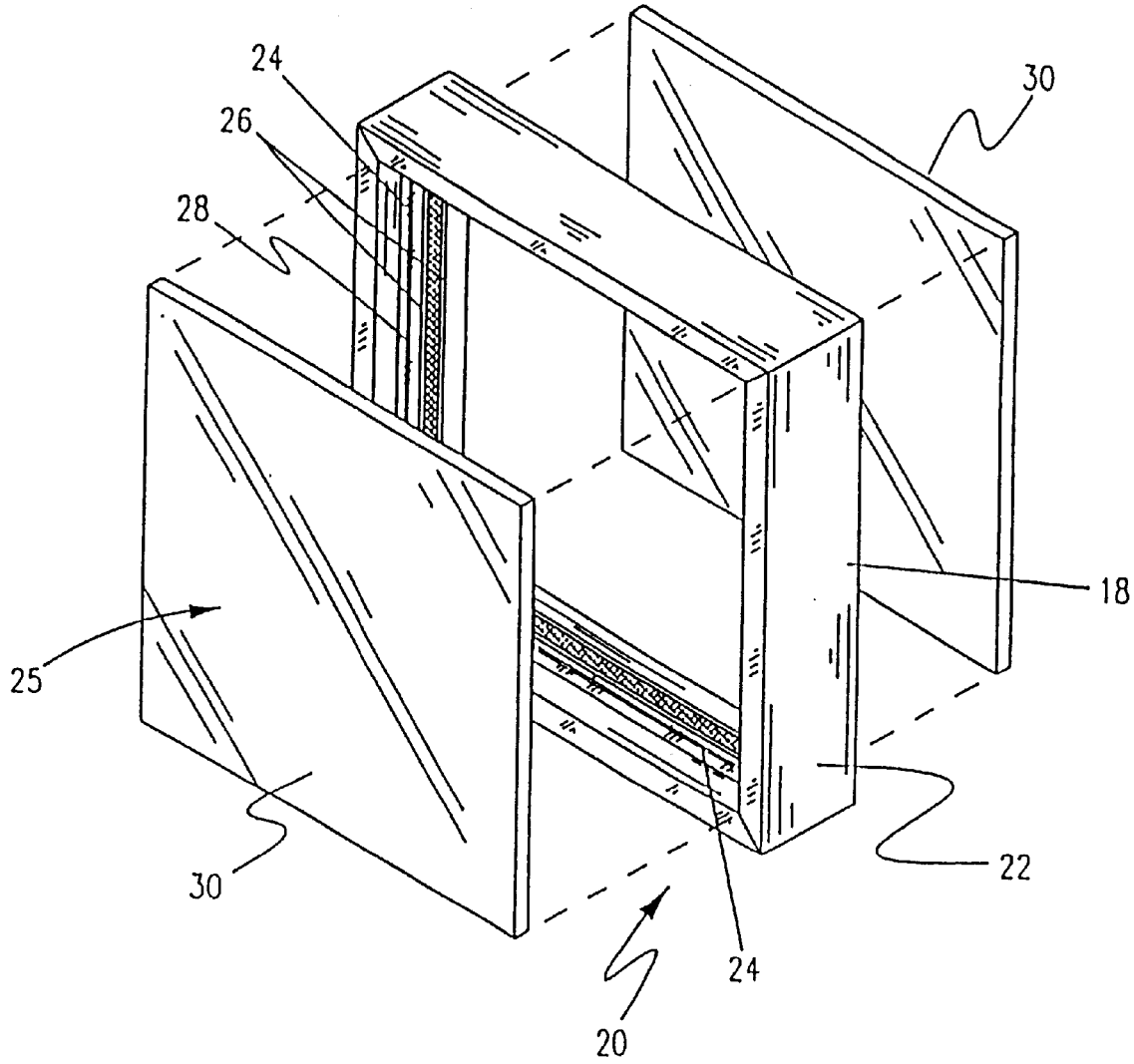
FIG. 2 is an exploded perspective view of a window sash frame according to a first preferred embodiment of an integrated multipane window unit and sash assembly according to the present invention.

Referring to FIG. 2, an integrated multipane window unit and sash combination 20 is disclosed having a sash frame 22 that incorporates an integral spacing structure 24 formed integrally with the sash frame and protruding toward the viewing opening (generally, 25). The integral spacing structure 24 incorporates at least two vertical internal glazing surfaces 26 upon which adhesive, or sealant 28 is affixed. Sealant strips or beads 28, connecting respective glazing panes 30 to the integral spacing structure 24, are isolated from each other, thereby allowing each pane 30 to function independently.

As noted above, a well performing thermal air space will allow for glazing panes to expand and contract without stress to point where stress fractures would occur, or where sealant would deform and fail to maintain structural integrity. Since stresses between the glazing panes and sealant will inevitably take place, the present invention allows for the stresses of the pane 30 (which can be, e.g., glass, plastic or the like) to act directly upon the sash element via the vertical glazing surface through the sealant, and not be transferred to the opposing pane, thereby allowing such stress and movement to occur in a manner that diminishes the full load of such forces on the glazing panes and sealant. This is done by providing the integrated spacing structure that allows the glazing panes to "float" on sealant, thereby substantially preventing direct contact with the sash profile. The term "float" as used herein is not intended to preclude occasional or accidental contact of the glazing panes with the sash profile, but only to indicate that along the majority of the glazing pane periphery, the glazing pane contacts the sealant, and not the sash profile.

Figure 3A:
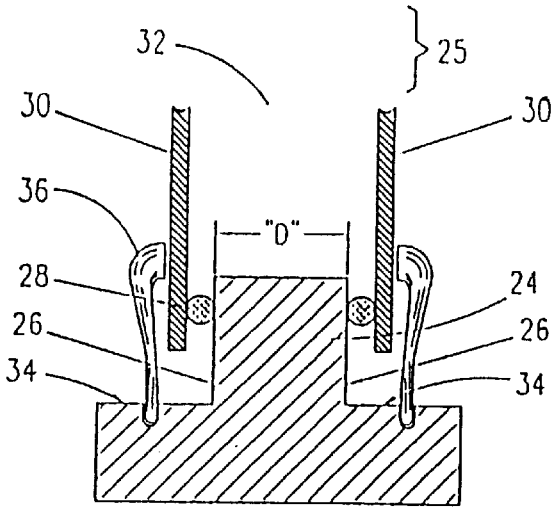
FIG. 3*a* is a partial cross sectional view of a sash frame element according to a first configuration of the present invention.

Further detail is shown in FIG. 3*a.* As described, the sash frame 22 directly incorporates an integral spacing structure 24. The spacing structure 24 is formed integrally with the sash frame. The sash frame 22 itself is formed in a rigid, structural manner, and provides all the necessary or required structural rigidity of the completed sash frame. Unlike with conventional windows, there is no rigid IG unit that inevitably must function to provide a certain amount of structural rigidity to the system. The function of the integral spacing structure 24 is two-fold: first, to provide a separation space "D" between glazing panes 30 in order to form an insulating air space 32; and second, to provide a pair of glazing surfaces, shown as internal glazing surfaces 26, upon which to mount each glazing pane 30.

Each PVC profile that forms a sash frame element 22 also includes an inner sash frame surface 34. The integral spacing structure 24 extends inwardly, above the level of the inner sash frame surface 34, and protrudes into the viewing opening (generally, 25). The integral spacing structure 24 incorporates at least two vertical internal glazing surfaces 26 upon which adhesive, or sealant 28 is affixed. Each strip or bead of sealant 28 connecting the respective glazing panes 30 to the integral spacing structure 24 is isolated from the other such strip or bead. The protrusion of the integral spacing structure 24 allows for a number of manufacturing benefits, which are described below, and also allows the sash frame 22 itself to be formed and designed to provide all the necessary structural rigidity that is required by the completed sash assembly. With the sash frame 24 completed and having the internal glazing surfaces 26 being accessible above the inner sash frame surface 34, the glazing panes 30 can be fitted onto the finished sash frame 24. Otherwise, the sash frame would be required to be built onto the glazing pane 30, resulting in the pane 30 being required to provide the structural integrity during the manufacturing process. Although such an embodiment is envisioned, and may exhibit some of the benefits anticipated by the present disclosure, such an embodiment is not considered to incorporate the best mode of the present invention.

Finally, a bead of sealant 28 is shown affixed to both the internal glazing surface 26 as well as the glazing pane 30. Since the expansion coefficient of the glazing pane is typically less than that of a PVC extrusion, such a sealant configuration prevents the glazing pane 30 from making direct contact with the extrusion vinyl. This structure avoids the disadvantages inherent in the state of the art, yet forms both a thermally sealed and structurally sealed space bounded on two sides by a glazing pane (e.g., a glass or plastic panel), and sealed around its periphery by an internal glazing structure. Further, it is anticipated that the dimensions of the glazing pane 30 would be overall less than that of the inner sash frame surface 34, thereby allowing for the glass to expand and contract without stresses that result in failure on either the glass or the sealant. Further still, any glass (or other glazing pane material) preferably rests above this extrusion shelf structure, thereby eliminating any stress against the edge of the glass that could cause cracking, as well as providing for water drainage away from the sealant, thereby lessening the opportunity for the sealant to come into contact with water.

Also envisioned is the otherwise conventional use of glazing clips or beads 36, for providing an aesthetic visual barrier to the glazing elements of the unit. Further, glazing clip 36 can also be used in a manner such as to hold the glazing 30 in place temporarily while allowing the sealant 28 to cure during the manufacturing process.

Figure 3B:
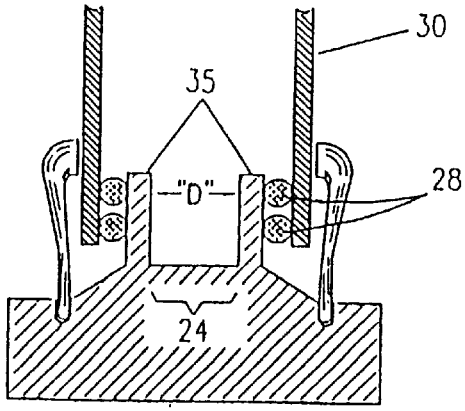
FIG. 3*b* a partial cross sectional view of a sash frame element according to a second configuration of the present invention.

FIG. 3*b* shows a second preferred embodiment of the present invention utilizing an integral spacing structure 24 that further provides a separation space "D" between a pair of parallel, vertically spaced internal glazing legs 35. Each glazing leg 35 provides a glazing surface upon which to mount a corresponding glazing pane 30. Further, each glazing leg allows for each pane to expand and contract independently without stresses that result in failure on either the glass or the sealant, and diminishes the full load of such forces on glass and sealant. This allows for each glazing pane to expand and contract independently without stresses that result in failure of either the glass or the sealant. Also, such a configuration provides added sound deadening characteristics in that the minimal possible surface area is shared between glass and spacer.

Finally, FIG. 3*b* shows a configuration wherein multiple beads of sealant 28 are shown affixed to both the internal glazing surface 26 as well as the glazing pane 30. Such multiple beads would allow for the use of separate structural adhesive and vapor barrier sealants.

Figure 3C:
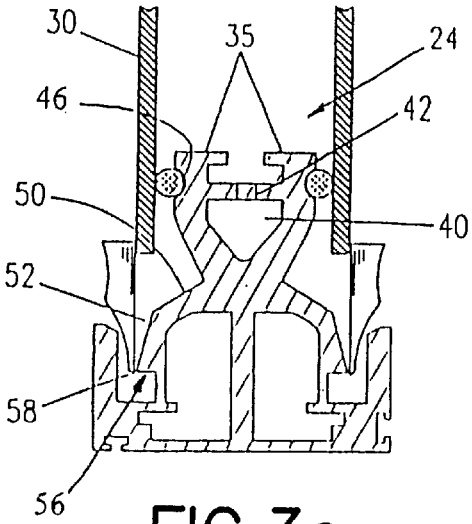
FIG. 3*c* is a partial cross sectional view of a sash frame element according to a third configuration of the present invention.

FIG. 3*c* shows a third embodiment of the present invention, and depicts an integral spacing structure 24 that further provides a separation space and a plurality of internal cavities and external feature surfaces. A pair of parallel, vertically spaced internal glazing legs 35 further form a desiccant receiving cavity 40. In this manner, desiccant (not shown), as well as desiccant of an otherwise conventional type can be incorporated into such a receiving cavity 40 and provided with air conduits 42 which provide fluid communication between the receiving cavity 42 and the internal, thermally sealed air space formed between the glazing panels 30. Each glazing leg 35 provides a glazing surface upon which to mount each glazing pane 30, as well as provides for lateral flexibility for receiving stresses communicated by the glazing panes 30 as they expand and contract.

Also shown formed within the sash frame profile are a plurality, in this case two, of internal frame cavities. In addition to manufacturing convenience, such cavities provide increased structural rigidity to the assembled sash frame. Further, it is envisioned that many such cavity designs can be incorporated to provide for various structural needs, as well as to receive other materials, such as desiccant, insulative material, or the like.

An additional feature disclosed in FIG. 3*c* is a sealant receiving recess 46, shown as a trough or notch recess below the outermost surface of the external glazing surface of each internal glazing leg. Such a structure allows for increased surface area contact between the sealant and glazing surface, increased volume availability for sealant material, as well as easier manufacturing in the application of sealant to the glazing surface.

Finally, a number of additional features are disclosed in the embodiment shown in FIG. 3*c*. These include: an internal offset surface 50, for accommodating the thickness of the glazing pane 30; an internal drainage slope 52 formed as a downwardly sloping surface along the top of the internal offset surface 50 for aiding in the drainage of moisture into a moisture collection channel 56; and, a glazing clip retaining channel 58 that provides for the dual functionality of retaining a glazing clip by frictional impingement as well as providing a drainage conduit for accumulated moisture.

Figure 3D:
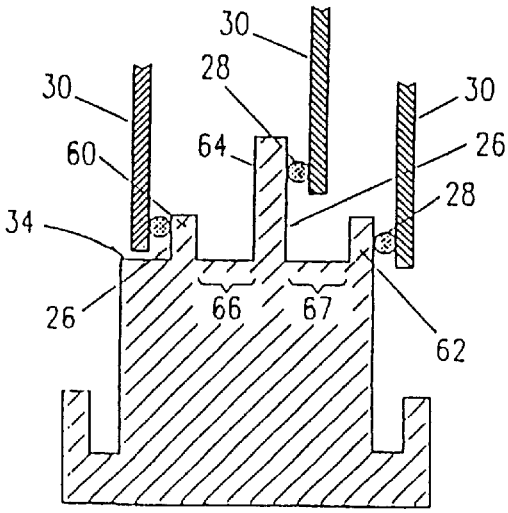
FIG. 3*d* is a partial cross sectional view of a sash frame element according to a fourth configuration of the present invention.

As shown in FIG. 3*d,* an alternate embodiment of the present invention is provided depicting the capability of triple glazing. Such an embodiment is depicted simply in order to communicate the essence of the teachings of the present invention. In such an embodiment, a sash frame is provided having a first internal glazing leg 60 formed integrally with the sash frame. The sash frame itself is formed in a rigid, structural manner, and provides all the necessary or required structural rigidity of the completed sash frame. A second internal glazing leg 62 is further formed integrally with the sash frame, and in a similar manner as and parallel to said first internal glazing leg. Additionally, a third internal glazing leg 64 is provided, located in the space formed between the first internal glazing leg and the second internal glazing leg. In this manner, a first separation space 66, between the first internal glazing leg and the third internal glazing leg, and a second separation space 67 between the second internal glazing leg and the third internal glazing leg, are formed. Each glazing leg incorporates a glazing surface upon which to mount a glazing pane 30. Each internal glazing leg extends inwardly, above the level of the inner sash frame surface 34 and protrudes into the viewing opening (generally, 25). In keeping with the manufacturing methods taught hereinbelow wherein the sash frame is fully assembled prior to glazing, it would be necessary for the third internal glazing leg to extend inwardly, above the level of one of the other internal glazing legs, and is shown herein as extending inwardly above the level of the second internal glazing leg. In this manner, the triple glazing integral spacing structure allows for three vertical internal glazing surfaces 26 upon which adhesive, or sealant 28 can be affixed and can thereby form a triple pane insulating unit.

Other adaptations of the present teachings can be envisioned. For purposes of example, and not by way of limitation, several variations are described herein:

1. In a two-internal glazing leg configuration, providing one glazing leg extending upward above the other in a manner that allows the user to affix glazing panes to both surfaces, thereby allowing for an alternate triple glazing configuration;
2. Incorporate muntin retaining clips or receiving notches 72 within the sash profile, and more particularly, within the separation space formed in the integral spacing structure formed of the vertically spaced internal glazing legs;
3. The use of a desiccant sealant material that provides conventional structural and vapor barrier characteristics along with desiccant properties, made possible in a configuration that allows the internal cavity 31 to have contact with the internal surface of 29 of the sealant;
4. The use of traditional IG units in place of single glass glazing panes, thereby allowing the combined benefits of the two technologies; and
5. Incorporation of tempered, stained, plate, bullet proof, or other specialty glasses that could not otherwise be subject to the heat and pressures necessary for curing of traditional IG units as glazing panes, thereby allowing for the expanded use of insulating glass windows into a variety of areas where such use is currently unavailable.

Figure 4A:
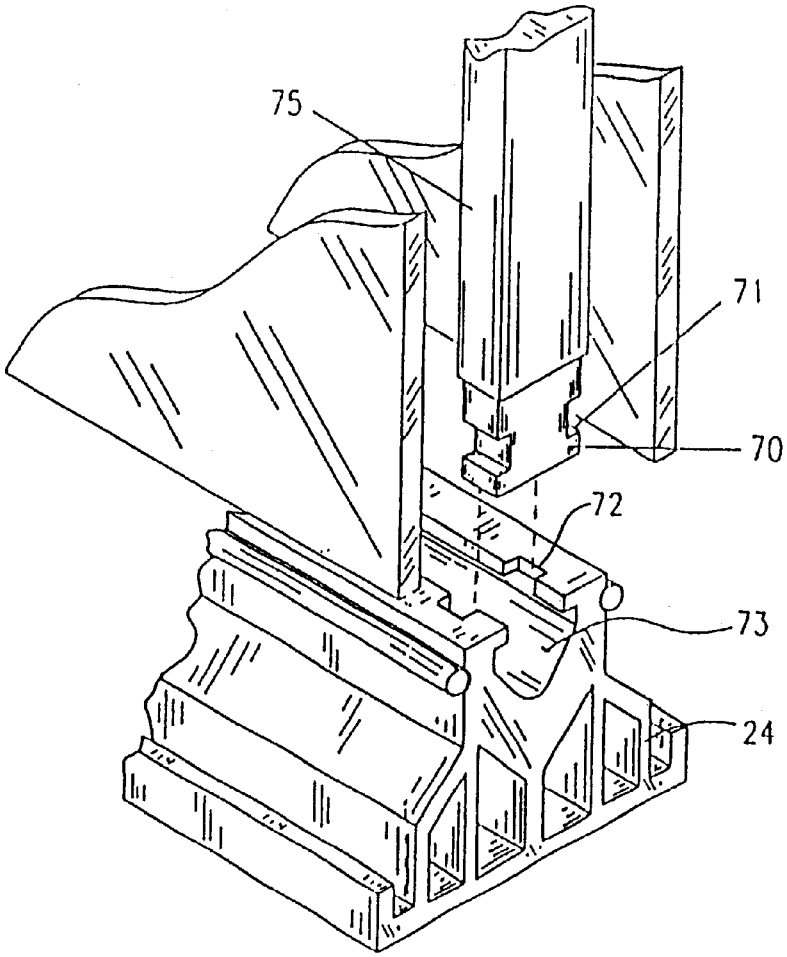
FIG. 4*a* is a partial exploded perspective view of a muntin assembly connection shown in combination with the present invention.
Figure 4B:
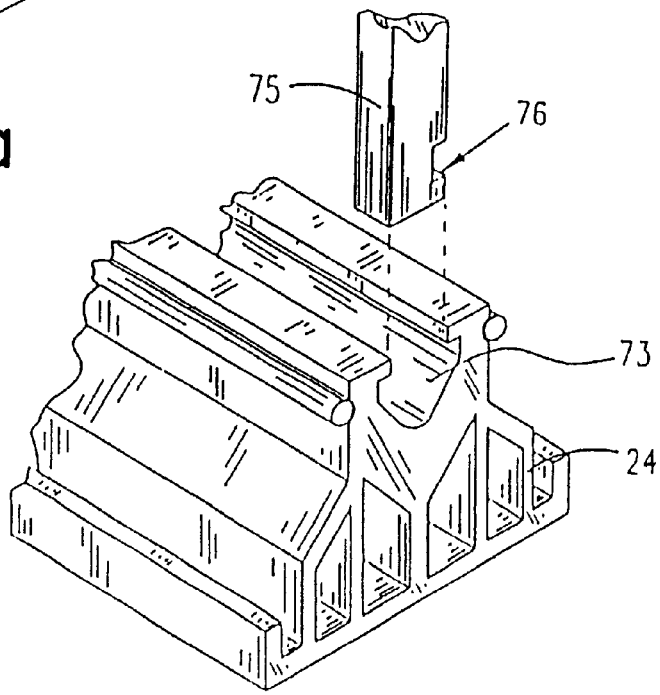
FIG. 4*b* is a partial exploded perspective view of an alternate design for a muntin assembly connection shown in combination with the present invention.

Additional benefits of the designs generated by the present invention, in all its variations, embodiments, and improvements, include the ability to include muntin bars between the sealed insulating space and affixed directly to the sash frame. As best shown in FIG. 4*a,* it is envisioned that a separate muntin retaining clip 70, having a frame affixment point 71, shown as an otherwise conventional friction fit, snap lock fastener element that is received within a clip receiving slot 73 formed by and within the sash frame member 24. In this configuration, it is envisioned that a muntin grid comprising hollow type grid members can thereby receive the opposite end of the clip 70. Use of a plurality of such clips 70 would result in the muntin assembly being retained within the insulative space and yet affixed directly to the sash frame. By way of merely one further example of many possible, and not meant in limitation, as shown in FIG. 4*b,* a muntin grid element 75 can incorporate a sash frame receiving notch 76 directly within the grid element. Such a configuration can then be received and retained directly by a clip receiving slot 73 formed by and within the sash frame member 24. Use of a plurality of such notches and slots would again result in the muntin assembly being retained within the insulative space and yet affixed directly to the sash frame.

Figure 5:
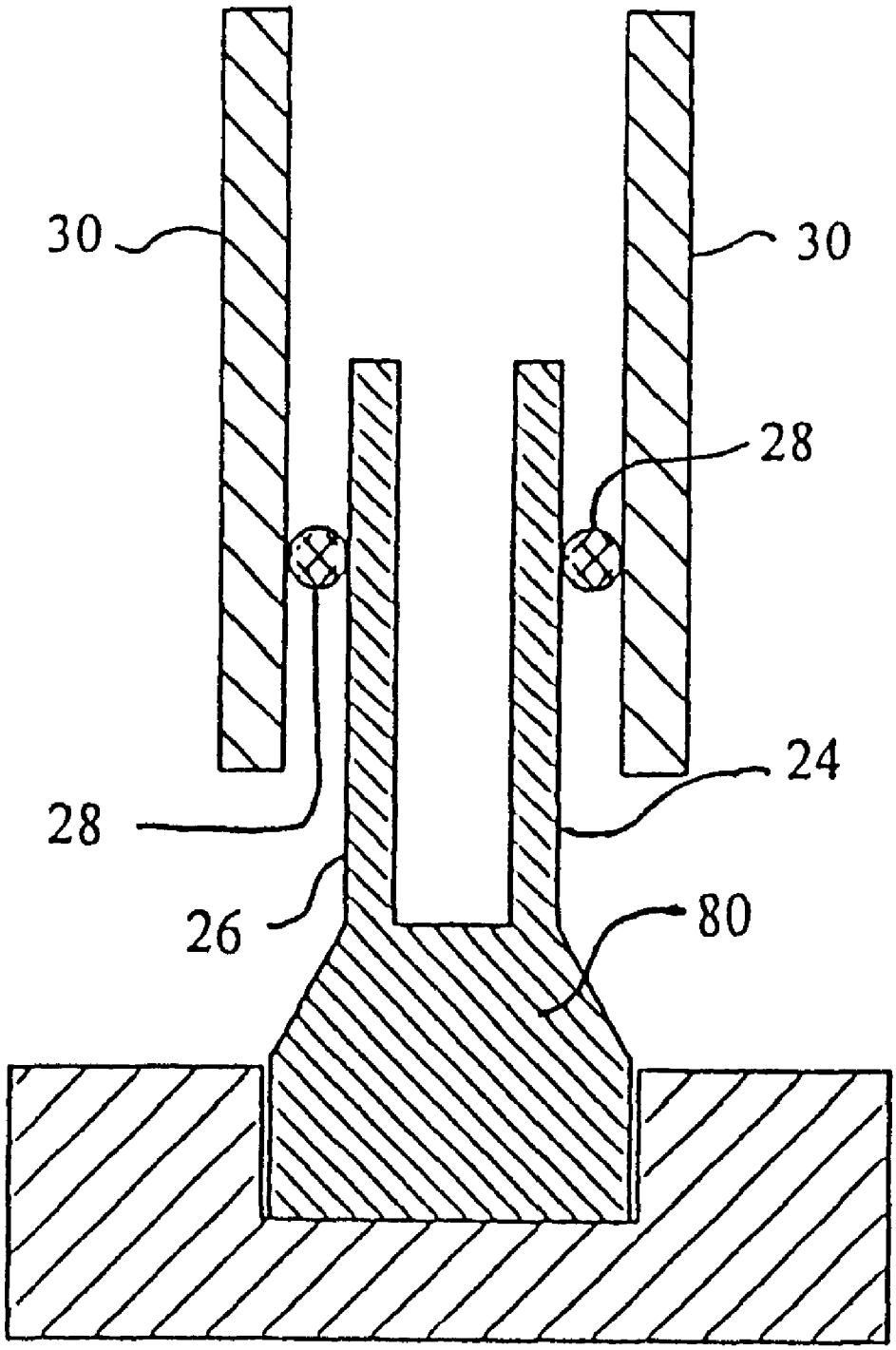
FIG. 5 is a partial cross sectional view of a sash frame element incorporating the teachings of the present invention for use with a wood-frame, aluminum, or other sash material.
Figure 6:
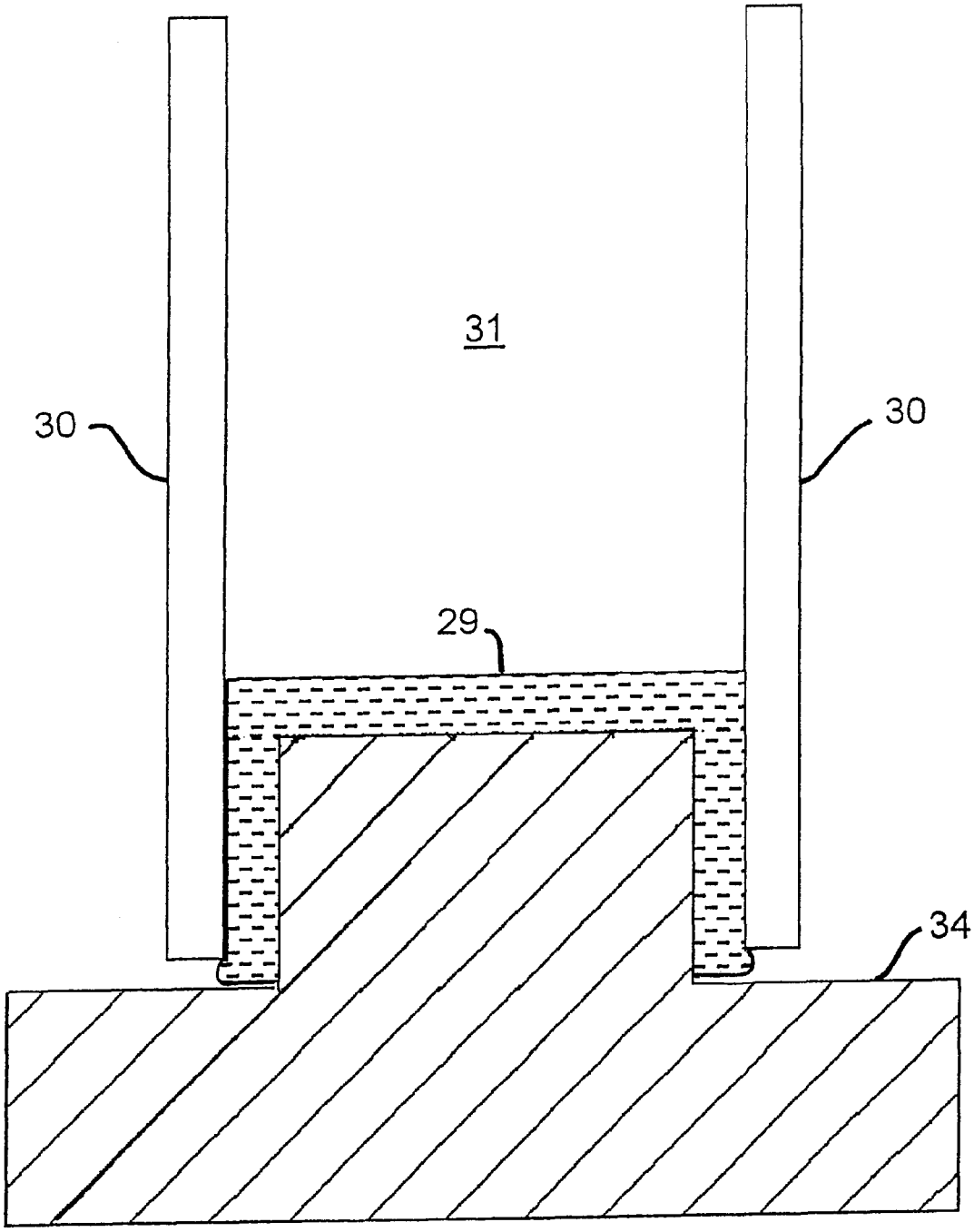
FIG. 6 is a partial cross sectional view of a sash frame element similar to that of FIG. 3*a,* wherein the sealant material provides vapor barrier characteristics in a configuration that allows the internal cavity to have contact with the internal surface of the sealant.

One final example of the utilization of the teachings of the present disclosure is further shown in FIG. 5, wherein the technology taught and described is adapted for use in the manufacture of windows made with wood, aluminum, or other sash material. Such a configuration is made possible by use of an internal glazing insert 80, formed in a manner similar to that anticipated above with respect to the sash frame, except made in a manner to be incorporated or inserted into a conventional window (e.g., wood, aluminum, etc.) in a manner that would otherwise be done with a conventional IG unit.

As such, an integrated multipane window insert 80 is disclosed having an insert frame that incorporates an integral spacing structure 24 formed integrally with the insert frame and protruding toward the viewing opening. The integral spacing structure 24 incorporates at least two vertical internal glazing surfaces 26 upon which adhesive, or sealant 28 is affixed. Sealant strips or beads 28 connecting each glazing pane 30 to the integral spacing structure 24 are isolated from each other, thereby allowing each pane 30 to function independently. In this manner, the qualities of well performing thermal air space are achieved while allowing the glass to expand and contract without stress on the glass to the point where stress fracture would occur. This structure also prevents the sealant from deforming to a point where it fails to maintain structural integrity, and can be added to an otherwise conventional wood or aluminum, etc. sash frame. In this manner, stresses between the glass and sealant, which will inevitably take place, will be transferred to the PVC insert, rather than against the sash frame.

2. Detailed Description of the Method of Producing the Apparatus

In addition to the functional and performance advantages resulting from the features of an apparatus configured according to the present disclosure, numerous improvements to the manufacturing process can also result. As such, the manufacture of an integrated multipane window unit and sash combination, having an integral spacing structure formed integrally with the sash frame and protruding toward the viewing opening, allows for an efficient manufacturing process in which the sash can be formed initially in an otherwise conventional manner. Subsequent to the initial forming of a structurally rigid sash member, sealant, either of a structural type, vapor barrier type, a combined type, or both types, can be applied directly to the vertical internal glazing surfaces of the finished sash frame. Next, because the internal glazing surfaces and spacing structure protrude into the viewing opening, the glazing panes can then be affixed to the sealant. At this point a glazing clip can be affixed in a manner that holds glass in place temporarily while allowing the sealant to cure during the manufacturing process.

Advantages of the present method can be readily seen from the present disclosure; however, they can be summarized in the providing of such a window unit in a manner that is less capital intensive and requires fewer manufacturing steps, equipment and personnel than what is required to manufacture windows using exiting IG units.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A method for fabricating an insulating sash unit, comprising the steps of:

forming a structurally rigid sash having an inside perimeter with a glazing pane spacing and mounting structure extending from said inside perimeter;

said spacing and mounting structure defining a reduced perimeter within said inside perimeter and providing a pair of oppositely facing mounting surfaces for mounting separate glazing panes, each pane having a perimeter that is less than the inside perimeter of the sash and greater than said reduced perimeter; and adhesively mounting the glazing panes to respective ones of the mounting surfaces via sealant;

wherein said spacing and mounting structure maintains planar window surfaces of said glazing panes substantially parallel to each other with a sealed fixed insulating space therebetween after the fabrication of said sash is completed, and said glazing panes are isolated from one another, with said sealant allowing the glazing panes to expand and contract independently, thereby reducing the chance of stress fractures caused by stress on the panes.

2. A method in accordance with claim 1, wherein the spacing and mounting structure in combination with said sealant allows the glazing panes to function independently with respect to stresses.

3. A method accordance with claim 1, comprising the step of providing a desiccant within said fixed space.

4. A method in accordance with claim 1, comprising the step of attaching at least one simulated muntin to said spacing and mounting structure, said simulated muntin residing within said fixed space after said glazing panes are applied.

5. A method in accordance with claim 4, wherein said muntin is attached to the spacing and mounting structure with a retaining clip.

6. A method in accordance with claim 1, comprising the step of applying glazing beads to said sash after the glazing panes are applied.

7. A method in accordance with claim 1, wherein said glazing panes are mounted in said sash such that perimeter edges of the panes are spaced from the inside perimeter of the sash.

8. A method for fabricating an insulating sash unit, comprising:

forming a structurally rigid sash having an inside perimeter with a glazing pane spacing and mounting structure extending from said inside perimeter;

said spacing and mounting structure having a first mounting surface for a first glazing pane and a second mounting surface for a second glazing pane, and being adapted to maintain planar window surfaces of said glazing panes substantially parallel to each other with an internal cavity therebetween when the glazing panes are mounted to the mounting surfaces within said inside perimeter;

applying a sealant material (i) to said mounting surfaces for use in adhering the respective glazing panes thereto and (ii) within the internal cavity between said mounting surfaces to form a vapor barrier covering the spacing and mounting structure between said mounting surfaces; and applying the first and second glazing panes to the sealant on the respective first and second mounting surfaces, such that the glazing panes are adhesively mounted via the sealant on their respective mounting surfaces.

9. A method in accordance with claim 8, wherein said glazing panes are mounted in said sash such that perimeter edges of the panes are spaced from the inside perimeter of the sash.

10. A method in accordance with claim 8, wherein said sealant is desiccated.

11. A method in accordance with claim 8, comprising the step of attaching at least one simulated muntin to said spacing and mounting structure, said simulated muntin residing within said internal cavity after said glazing panes are applied.

12. A method in accordance with claim 11, wherein said muntin is attached to the spacing and mounting structure with a retaining clip.

13. A multipane window unit comprising:

a structurally rigid sash having an inside perimeter with a glazing pane spacing and mounting structure extending from the inside perimeter;

said spacing and mounting structure having a first mounting surface for a first glazing pane and a second mounting surface for a second glazing pane, and being adapted to maintain planar window surfaces of said glazing panes substantially parallel to each other with an internal cavity therebetween when the glazing panes are mounted to the mounting surfaces within said inside perimeter; and a sealant material (i) on said mounting surfaces adhering the respective glazing panes thereto and (ii) within the internal cavity between said mounting surfaces to form a vapor barrier covering the spacing and mounting structure between said mounting surfaces.

14. A multipane window unit in accordance with claim 13, wherein said glazing panes are mounted in said sash such that perimeter edges of the panes are spaced from the inside perimeter of the sash.

15. A multipane window unit in accordance with claim 13, wherein said sealant material is desiccated.

16. A multipane window unit in accordance with claim 13, further comprising one of a trough or recess for said sealant in each of said mounting surfaces.

17. A multipane window unit in accordance with claim 13, further comprising at least one glazing clip for holding at least one of the glazing panes.

18. A multipane window unit in accordance with claim 13, further comprising at least one simulated muntin attached to said spacing and mounting structure and residing within said internal cavity.

19. A multipane window unit in accordance with claim 18, wherein said muntin is attached to the spacing and mounting structure with a retaining clip.

20. A multipane window unit comprising:

a structurally rigid sash profile surrounding a viewing opening and having a glazing pane spacing and mounting structure extending therefrom toward said viewing opening;

said spacing and mounting structure having a pair of oppositely facing mounting surfaces for respective first and second glazing panes, and being adapted to space planar window surfaces of said glazing panes apart with a sealed internal cavity therebetween when the glazing panes are mounted to their respective mounting surfaces; and a sealant material adhering the glazing panes to their respective mounting surfaces;

wherein: the glazing panes are not rigidly connected or connected to the spacing and mounting structure in a fixed manner, thereby reducing the possibility for stress fractures to occur.

21. A multipane window unit in accordance with claim 10, wherein said sealed internal cavity encloses a gas therebetween.

22. A multipane window unit in accordance with claim 10, wherein said glazing panes are mounted in said sash such that perimeter edges of the panes are spaced from an inside perimeter of the sash.

23. A multipane window unit in accordance with claim 10, wherein said sealant material is desiccated.

24. A multipane window unit in accordance with claim 10, further comprising one of a trough or recess for said sealant material in each of said mounting surfaces.

25. A multipane window unit in accordance with claim 10, further comprising at least one glazing clip for holding at least one of the glazing panes in place.

26. A multipane window unit in accordance with claim 10, wherein sealant material is provided on said spacing and mounting structure within said sealed internal cavity to form a vapor barrier.

27. A multipane window unit in accordance with claim 10, further comprising at least one simulated muntin attached to said spacing and mounting structure and residing within said internal cavity.

28. A multipane window unit in accordance with claim 27, wherein said muntin is attached to the spacing and mounting structure with a retaining clip.

29. A multipane window unit comprising:

a structurally rigid sash profile forming a frame surrounding a viewing opening, said frame having an inner sash frame surface;

a glazing pane spacing and mounting structure extending from the inner sash frame surface toward said viewing opening;

said spacing and mounting structure having a first leg extending toward the viewing opening to provide a mounting surface for a first glazing pane, and a second leg extending further toward said viewing opening than said first leg, to provide a mounting surface for a second glazing pane;

said spacing and mounting structure maintaining planar window surfaces of said glazing panes in a spaced apart relationship with a sealed internal cavity therebetween, when the glazing panes are mounted to their respective mounting surfaces via a sealant material.

30. A multipane window unit in accordance with claim 28 wherein:

said first glazing pane is mounted to a side of the first leg that faces away from said internal cavity; and said second glazing pane is mounted to a side of the second leg that faces away from said internal cavity.

31. A multipane window unit in accordance with claim 29, wherein:

said first glazing pane is mounted to a side of the first leg that faces away from said internal cavity; and said second glazing pane is mounted to a side of the second leg that faces said internal cavity.

32. A multipane window unit in accordance with claim 29, wherein said spacing and mounting structure comprises an additional mounting surface for a third glazing pane.

33. A multipane window unit in accordance with claim 32, wherein said additional mounting surface comprises a third leg extending toward the viewing opening.

34. A multipane window unit in accordance with claim 33, wherein said second leg extends further into said viewing opening than said third leg.

35. A multipane window unit in accordance with claim 29, wherein said first and third legs extend the same amount into said viewing opening.

36. A multipane window unit in accordance with claim 29, wherein an inner edge of the second leg defines the viewing opening.

37. A multipane window unit in accordance with claim 29, wherein the glazing panes are unconnected to each other over substantially their entire surface area except through the sealant and intervening spacing and mounting structure.

* * * * *